US005607347A

United States Patent [19]

Schoen et al.

[11] Patent Number: 5,607,347

[45] Date of Patent: Mar. 4, 1997

[54] ICE SKATE BLADE SHARPENER

[75] Inventors: Steven J. Schoen, Maple Grove; Paul E. Schoen, Clear Lake; Todd M. Luoma, Coleraine, all of Minn.

[73] Assignee: AroSport Marketing, Inc., Monticello, Minn.

[21] Appl. No.: 628,892

[22] Filed: Apr. 5, 1996

Related U.S. Application Data

[63] Continuation of Ser. No. 445,298, May 19, 1995, abandoned.

[51] Int. Cl.[6] ..... B24B 9/04

[52] U.S. Cl. ..... 451/558; 451/451; 76/83

[58] Field of Search ..... 451/558, 557, 451/545, 540, 523, 524, 451; 76/82, 83, 88

[56] References Cited

U.S. PATENT DOCUMENTS

| | | | |
|---|---|---|---|
| D. 295,142 | 4/1988 | Patrick | D8/91 |
| 594,723 | 11/1897 | Boettcher | 76/83 |
| 824,992 | 7/1906 | Lawrence | 76/88 |
| 1,006,000 | 10/1911 | Oosdyke | 76/83 |
| 1,273,624 | 7/1918 | Krollius | 451/555 |
| 2,054,495 | 9/1936 | Corkum | 451/558 |
| 2,092,831 | 9/1937 | Cannon | 451/558 |
| 2,118,617 | 5/1938 | Nicolet | 451/558 |
| 2,398,566 | 4/1946 | Talbert | 451/558 |
| 2,428,473 | 10/1947 | Slocum | 451/558 |
| 2,550,765 | 5/1951 | Brown | 451/523 |
| 3,841,030 | 10/1974 | Laszlo | 451/358 |
| 4,219,975 | 9/1980 | Scholler | 451/558 |
| 4,910,923 | 3/1990 | McCabe | 451/558 |
| 5,197,232 | 3/1993 | Ellstad | 76/83 |
| 5,381,629 | 1/1995 | Salvail | 451/545 |
| 5,383,307 | 1/1995 | Anderson | 451/545 |
| 5,431,597 | 7/1995 | Anderson | 451/558 |

FOREIGN PATENT DOCUMENTS

| | | | |
|---|---|---|---|
| 0668293 | 8/1965 | Canada | 451/558 |

*Primary Examiner*—Robert A. Rose

*Attorney, Agent, or Firm*—Nawrocki, Rooney & Sivertson, P.A.

[57] ABSTRACT

Improved apparatus for sharpening a blade of an ice skate. The device includes a plurality of abrasive element holders, each having an external profile substantially the same as that of the other holders. Each holder is provided with a cavity formed therewithin within which an abrasive element can be received. An abrasive element is received within its corresponding holder with an arcuate surface of the element, having a radius of curvature different from that of an arcuate surface of another abrasive element, exposed on one side of the holder. Each holder can, in turn, be received within a chamber defined within a housing. The housing is provided with an elongated slot so that a blade of an ice skate can be passed therethrough and brought into engagement with the abrasive element received within the holder held within the housing. Means are provided to orient an abrasive element holder received within the chamber so that the exposed arcuate surface of the abrasive element can be engaged by the blade of the ice skate as the blade is passed through the slot.

18 Claims, 3 Drawing Sheets

ICE SKATE BLADE SHARPENER

This is a continuation of application Ser. No. 08/445,298 filed on May 19, 1995 now abandoned.

TECHNICAL FIELD

The present invention deals broadly with the field of athletic equipment. More specifically, however, it deals with the field of ice skates and apparatus for sharpening ice skate blades. A specific focus of the invention is an apparatus which can be quickly and easily used manually by an owner of a pair of ice skates to sharpen the blades thereof.

BACKGROUND OF THE INVENTION

Ice hockey is a sport in which many people participate. Participation is at a high level not only in the United States and Canada, but worldwide also.

Ages and skill levels of participation vary from the mere novice to a highly proficient professional. At any level, however, it is desirable to have a way in which the blades of the participants' ice skates can be sharpened. With time and use, the blades lose their edge, and the ability of the skater to function at his or her highest level becomes diminished.

Additionally, sharpening will be different depending upon the intended use of the pair of skates. For example, hockey skates would be sharpened with an abrasive element having an arcuate surface with a radius of curvature different than the radius of curvature of an arcuate surface of an abrasive element intended to be used for figure skates. Even where a participant is involved only in hockey, for example, blade widths of different pairs of skates and other factors might dictate the use of a plurality of abrasive elements having arcuate surfaces with different radii of curvature. Also, each individual skater has his or her own preference for the sharpness of skates. The smaller the radius, the sharper the blade edges. Also, the competition and/or ice surface on which a skater is competing or skating may dictate radius edge preference. As can be seen then, it is desirable to be able to change abrasive elements depending upon various dictates.

U.S. Pat. No. 5,383,307 which was issued to Bradley J. Anderson on Jun. 24, 1995 for a device characterized as a SKATE BLADE EDGE RESURFACER illustrates a device which can be used by virtually anyone to quickly and easily sharpen the blades of a pair of ice skates. That structure, however, has a number of significant drawbacks. The patent illustrates a sharpening device having a longitudinally extending bore formed through a housing. A cylindrical abrasive element, having a diameter slightly smaller than that of the bore, is inserted into the bore and maintained therein by means of pins made to extend across the bore and engage the abrasive element, when it is received within the bore, at either end thereof. Consequently, a separate sharpening apparatus must be owned and maintained by an individual for each individual skate sharpening preference. That is, the skate sharpening apparatus does not have universal application. As a result, undue expense must be incurred by an individual if numerous blade sharpening applications are necessary to be performed.

Even if a single application is to be performed, the device of the Anderson '307 patent has drawbacks. For example, over time, an abrasive element will become too smooth to effect further adequate sharpening of ice skate blades. It then would become necessary to replace the cylindrical sharpening element. Because of the manner in which the abrasive element is held in place (that is, by pins crossing the bore), it can be difficult to effect replacement.

Further, the sharpening device of the Anderson '307 patent, because of its construction, does not enable rotation of the abrasive element while sharpening is being done. It is frequently desirable to effect such rotation during the sharpening procedure in order to present a different portion of the abrasive element for engagement by the blade edge.

It is to these problems and dictates of the prior art that the present invention is directed. A device in accordance with the present invention is an improved ice skate sharpening apparatus which addresses and provides solutions to these dictates and problems.

SUMMARY OF THE INVENTION

The present invention is a device for sharpening an ice skate blade. It includes a plurality of abrasive element holders which can be utilized with a single housing. Each abrasive element holder has an external profile which is substantially the same as that of the other holders. Each holder has, formed therein, a cavity to receive an abrasive element having an arcuate surface. The radii of curvature of abrasive elements used with different holders are different. Consequently, the cavities formed in the holders are sized and shaped differently to accommodate the particular abrasive element to be used therewith. The cavity formed in a particular holder is provided at a location so as to expose the arcuate surface of the abrasive element on the side of the holder when the abrasive element is received within the cavity in the holder. The device also includes, as previously indicated, a common housing used with any one of the abrasive element holders. The housing has a chamber formed therein which is sized and shaped to receive any one of the holders therein. The housing is provided with an elongated slot which communicates with the chamber. The slot enables a blade of an ice skate to be sharpened to pass therethrough and into engagement with the abrasive element received in the cavity of the holder maintained within the chamber. Means are also provided to orient the particular abrasive element holder received in the chamber so that the exposed arcuate surface of the abrasive element received in the cavity addresses the slot in the housing. This will ensure that a skate blade passed through the slot in the housing will always be brought into engagement with the abrasive element surface.

In one embodiment of the invention, the chamber formed in the housing is generally cylindrical so as to accommodate a generally cylindrical abrasive element-carrying holder. Similarly, cavities formed in the various holders can be cylindrical to accommodate cylindrical abrasive elements. In this embodiment, a cavity formed in a holder would be eccentric with respect to a longitudinal axis of the holder so that, when an abrasive element is received within the cavity, an outer abrasive surface of the element would be exposed through a discontinuity in the holder and generally conformed to the periphery of the holder.

In embodiments of the invention, the housing can be bifurcated to facilitate insertion of an abrasive element-carrying holder. In a preferred embodiment, bifurcation is along a plane generally perpendicular to a longitudinal axis of the chamber formed in the housing. Such a construction enables opposite axial ends of the housing to be closed and the abrasive element-carrying holder to be received within the housing by closure of the two housing portions defined by the bifurcation about the holder.

In this embodiment, a plurality of alignment pins, each extending from one of the housing portions, can be provided to cooperate with corresponding alignment apertures formed in the other housing portion. Such a structure enables axial alignment, and to some extent, maintenance of the portions formed by bifurcation of the housing in a configuration closed around an abrasive element-carrying holder.

In the preferred embodiment, however, more positive means can be provided to maintain the housing portions in a mated configuration. This embodiment envisions provision of a saddle which is receivable over the housing, wherein the saddle straddles a seam at which the housing portions engage each other. The saddle is provided, at each of opposite axial end portions thereof, with an inwardly facing shoulder. Such shoulders engage, when the saddle is received over the housing, outwardly facing shoulders defined in each of the housing portions.

The invention can also include means for securing the saddle to the housing when it is brought about the housing to effect mating of the portions of the housing one to another. The saddle can be provided, along one or more axially-extending edges of the saddle, with a latch or latches. Each latch provided is engagable with an axially-extending surface formed in at least one of the housing portions to retard withdrawal of the saddle once it is in position. It will be understood that, in this embodiment, the saddle would have some measure of flexibility so as to enable disengagement of the latch from the axially-extending surface to enable unmating of the housing portions from each other.

The invention envisions provision of means to maintain each abrasive element holder in an orientation within the chamber formed in the housing so that the exposed arcuate surface of the abrasive sharpening element would be registered with the slot. In one embodiment, such means can include a key formed in, and extending radially outwardly from, a circumferential surface of a holder. Such a key does, in turn, cooperate with a keyway, provided at a desired circumferential location about the wall defining the chamber within the housing, to effect desired orientation of the holder within the housing chamber. In the preferred embodiment, the keyway, intended to receive a corresponding key of each holder, is formed in the chamber-defining wall of the housing at approximately 180° from the slot.

The invention also envisions means for facilitating rotation of an abrasive element carried by a holder received within the housing. A recess can be provided for this purpose, the recess extending through the saddle, the housing wall and a location in the holder received within the housing, wherein the registered recess holes in the saddle, the housing wall and holder are aligned when the key extending from the holder is received within the keyway formed in the wall defining the chamber in the housing. It has been found that, to satisfy ergonomic dictates, such a recess would be circumferentially spaced from the slot in the housing at approximately 90°, thus providing access to rotate the abrasive element without lifting the object off of the skate blade.

The present invention is thus an improved device for sharpening ice skate blades. More specific features of the invention and the advantages obtained in view of those features will become apparent with regard to the DETAILED DESCRIPTION OF THE INVENTION, the appended claims, and the accompanying drawing figures.

DETAILED DESCRIPTION OF THE INVENTION

Figure 1:
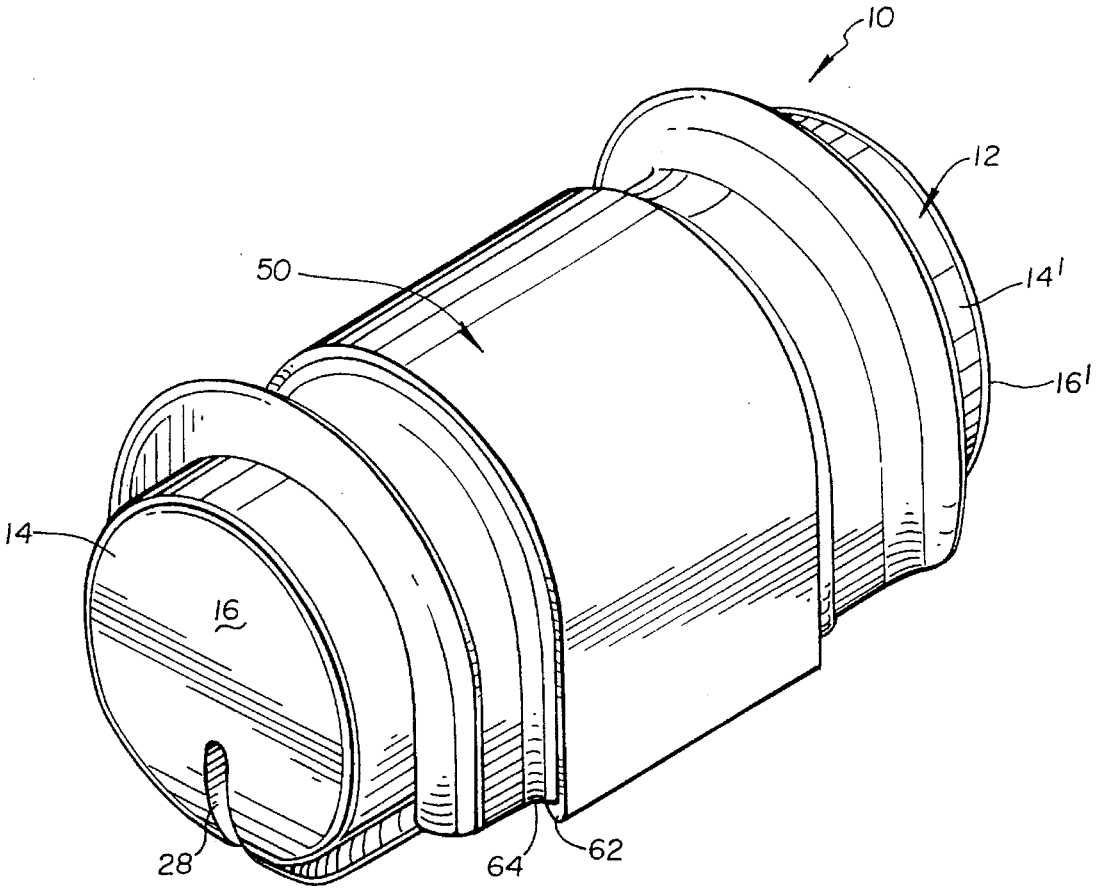
FIG. 1 is a perspective view of a structure in accordance with the present invention taken from the top thereof.
Figure 2:
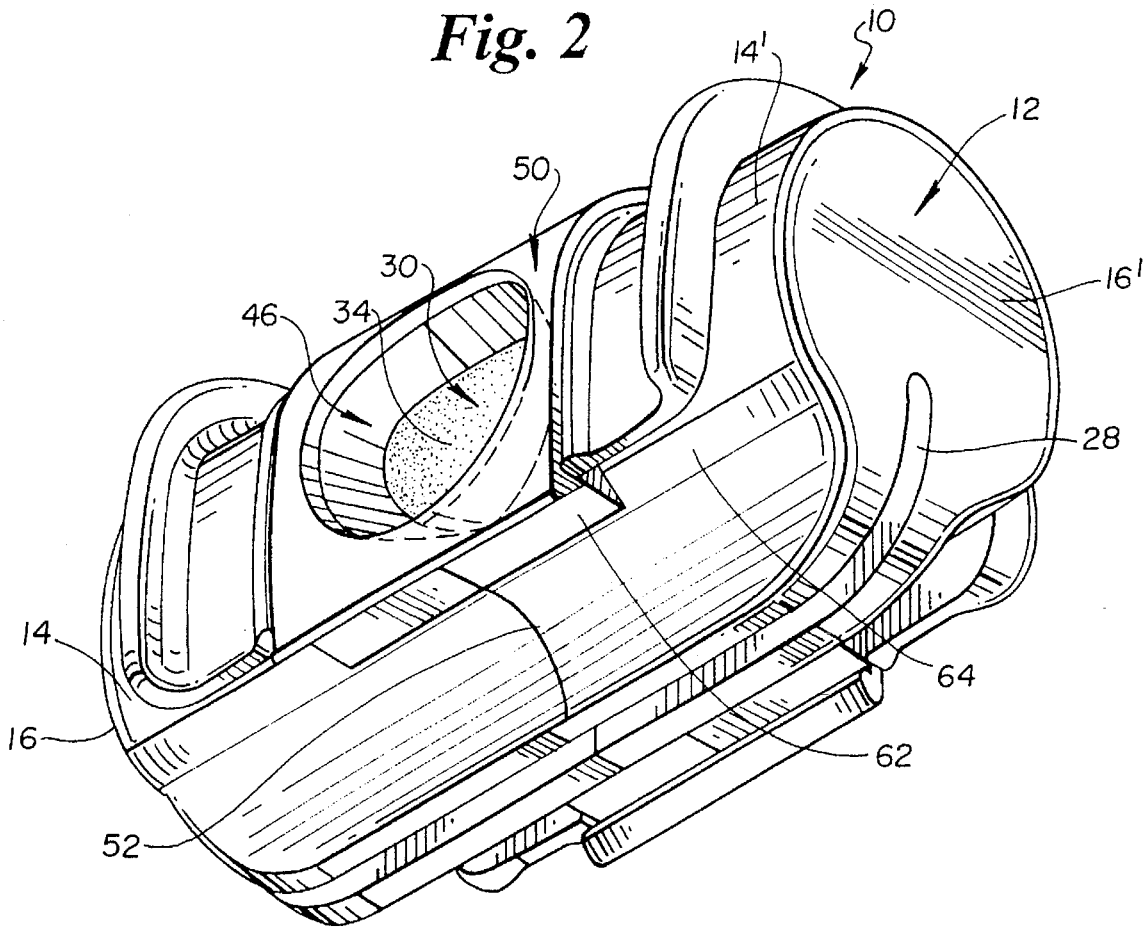
FIG. 2 is a perspective view of a structure in accordance with the present invention taken from the bottom thereof.
Figure 3:
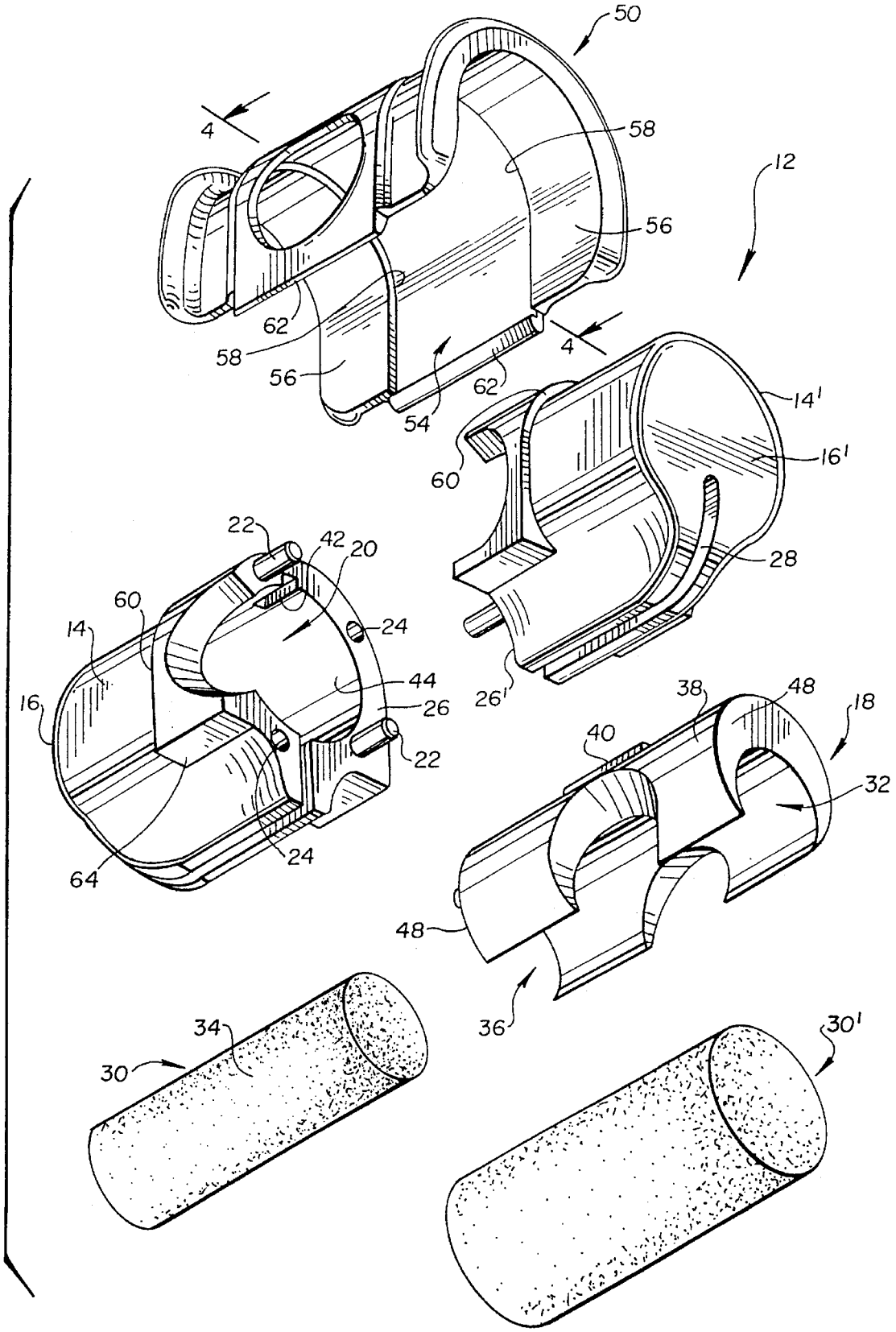
FIG. 3 is an exploded perspective view of the embodiment of FIGS. 1 and 2 showing subassembly details.

Referring now to the drawings, wherein like reference numerals denote like elements throughout the several views, FIGS. 1 and 2 illustrate different perspectives of the preferred embodiment of the present invention. Description of this embodiment will be made also with reference to FIG. 3. The ice skate sharpening device 10 includes a housing 12 which, as best seen in FIGS. 2 and 3, can be bifurcated for a purpose as will become apparent hereinafter. As shown in the figures, the housing 12 can be bifurcated along a plane generally perpendicular to a longitudinal axis of the housing 12. This construction enables the housing portions 14,14' to each define a solid, uninterrupted end wall 16,16' for holding an abrasive element-carrying holder 18 within a chamber 20 defined within the housing 12.

As best seen in FIG. 3, the illustrated embodiment employs a chamber 20 which is generally cylindrical in shape. It will be understood, however, that this shape is not exclusive and that other shaped chambers could be employed. In fact, by providing a chamber with a cross section that is not cylindrical, orientation of the abrasive element-carrying holder 18 within the chamber 20 can be accomplished. From a manufacturing standpoint, however, a circularly cylindrical construction of the chamber 20 and holder 18 is desirable.

FIG. 3 also illustrates a series of alignment pins 22 and corresponding alignment apertures 24 formed in faces 26,26' of the housing portions 14,14' which are in engagement when the housing portions 14,14' are mated together. In the embodiment of FIG. 3, four pins 22 and four corresponding apertures 24 are illustrated. The illustrated embodiment provides two pins 22 carried by one housing portion and two more pins 22 carried by the other housing portion. The two pins 22 carried by each housing portion are, as illustrated, at diametrically opposed locations about the periphery of the engagement faces 26,26'.

It will be understood that the primary function of the pins 22 and corresponding apertures 24 is alignment of the housing portions 14,14' to effect registration of a chamber portion defined within one of the housing portions 14 with the chamber portion defined in the other housing portion 14'. The pins 22 can, however, be provided with diameters relative to the corresponding apertures 24 so that there is a friction fit. If desired, therefore, the pins 22 and corresponding apertures 24 can have a function to accomplish, to some extent, mating of the two housing portions 14,14' together.

As seen in FIG. 2, the housing 12 is also provided, through a lower wall thereof, with a continuously extending slot 28 which passes through the housing wall generally parallel to the longitudinal axis of the housing 12 and the chamber 20 defined therewithin. As seen in FIG. 3, the slot 28 communicates with the chamber 20 defined within the housing 12. Such a construction enables the edge of a blade of an ice skate to be sharpened to be brought into engagement with the abrasive element 30 carried by a holder 18 received within the chamber 20 in a manner as will be discussed hereinafter. Consequently, the alignment pins 22 and apertures 24, while effecting registration of the chamber portions in the two housing portions 14,14', also effect registration of portions of the slot 28 in each housing portion 14,14'. The registration of the slot portions effect continuity of the slot 28 and facilitate ease of passage of an ice skate blade through the slot 28.

Figure 5:
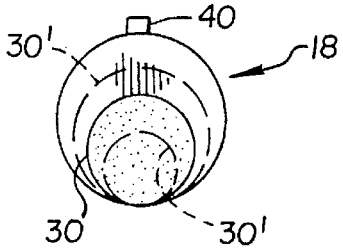
FIG. 5 is an end elevational view of an abrasive element received within its corresponding holder, with dashed lines indicating variations for accommodating different abrasive elements.

FIG. 3 also illustrates an abrasive element 30 as telescoped with respect to a holder 18 by which it can be carried. As seen in FIGS. 3 and 5, the holder 18 is generally circularly cylindrical in cross section. Similarly, the abrasive element 30 which it carries is also circularly cylindrical in cross section, with the abrasive element 30 having a diameter smaller than the diameter of the corresponding holder 18. The cavity 32 formed within the holder 18 within which the abrasive element 30 is received is not concentric with regard to the holder 18. Rather, it is eccentric and formed at a location so that, when the element 30 is received within the cavity 32, an outer peripheral surface 34 of the element 30 fills in a discontinuity 36 in the periphery 38 of the holder 18. Consequently, while the holder 18 carries the abrasive element 30, the surface 34 of the abrasive element 30 can still be exposed so that it can be engaged by the edge of the skate to be sharpened as the blade is passed through the slot 28 formed in the housing 12.

As can be seen then, in view of this disclosure, it is necessary to orient the holder 18 within the chamber 20 so that the exposed abrasive element 30 addresses, or is circumferentially aligned with, the slot 28. It is, of course, not desirable that the edge of the blade to be sharpened engage a sidewall of the holder 18.

Means are provided to facilitate proper circumferential orientation of a holder 18 within the chamber 20 of the housing 12. One embodiment employs a key 40 which extends generally radially from a peripheral surface 38 of the holder 18. The key 40, in turn, cooperates with a keyway 42 formed at an appropriate location about the periphery of the wall 44 defining the chamber 20 within the housing 12. When the abrasive element-carrying holder 18 would be inserted into a portion of the chamber 20 formed in one of the housing portions, the holder 18 would be rotated until the key 40 were aligned with the keyway 42 in that housing portion. Improper alignment would preclude full insertion of the holder 18 into the chamber portion. With the key 40 aligned with the keyway 42, however, the holder 18 could be moved axially a sufficient distance to achieve proper axial location.

FIG. 3 illustrates a keyway 42 which is formed in the wall 44 defining the chamber 20 of the housing 12 positioned at approximately 180° from the slot 28. This relationship is not exclusive, but it ensures that the keyway 42 does not obstruct, for example, a recess 46 formed through the housing 12 to allow rotation of the abrasive element 30 as will be discussed hereinafter.

FIGS. 3 and 5 illustrate alternative abrasive elements 30' which can be used depending upon the dictates of the application to which the sharpener 10 is to be put. It will be understood that, while the internal profile of the cavity 32 of one holder will be different from the internal profile of another holder, the external profiles of the various holders will be substantially identical. This will enable any holder to be properly received within the chamber 20 within the housing 12.

FIG. 5 illustrates the relative positioning of cavities within the respective abrasive element holders. It will be noted that, in all cases, a portion of the outer surface 34 of the abrasive element 30 substantially corresponds with, and fills a discontinuity 36 in, the corresponding holder 18. As a result, the abrasive element 30 carried by its corresponding holder 18 will not protrude radially from the holder 18. As a result, there will not be any problem in inserting the abrasive element-carrying holder 18 into the chamber portions of the various housing halves 14,14'.

In assembling the sharpening device, the particular abrasive element necessary will be selected based upon its radius of curvature. It will then be inserted into the cavity 32 in the corresponding holder 18. The abrasive element-carrying holder 18 will then be inserted into the chamber portion in one of the housing halves. The holder 18 will then be rotated until the key 40 aligns with the keyway 42 in the housing half. The holder 18 will then be moved axially until an end 48 of the holder 18 engages an inner surface of the end wall of the housing half. In some cases, the key/keyway combination could act as a stop if desired. That is, the length of the keyway 42 could be sufficiently short so that the end of the key 40 engages the end of the keyway 42 before the end wall 48 of the holder 18 engages the inner surface of the end wall of the housing half. In either case, however, proper positioning is accomplished.

With the holder 18 in this position, the second housing half is then placed over the opposite end of the abrasive element-carrying holder 18. Relative rotation of the holder 18 and this second housing half is accomplished until the key 40 becomes registered with the keyway portion in the second housing half. Simultaneously, because of the circumferential placement of the alignment pins 22 and apertures 24, the various pins 22 and their respective apertures will also be aligned. The second housing half is then closed axially so that inwardly facing faces 26,26' of the housing halves come into engagement as the alignment pins 22 enter their corresponding alignment apertures 24.

Figure 4:
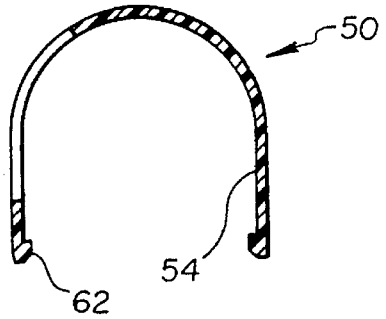
FIG. 4 is a sectional view taken generally along line 4—4 of FIG. 3.

As previously discussed, the alignment pins can be so structured relative to their corresponding alignment apertures 24 so that there will be a press fit and some maintenance of the housing portions 14,14' in a mated configuration. FIGS. 3 and 4 best illustrate, however, a saddle 50 which can be closed over the engaged housing portions 14,14' straddling a seam 52 at the interface of the portions. An inner surface 54 of the saddle 50 has opposite axial end portions 56, each of which defines an inwardly-facing shoulder 58 therein. As seen in FIG. 3, each of the housing halves 14,14' is provided with an outwardly facing shoulder 60,60'. These outwardly facing shoulders 60,60' are provided at locations at which, when the housing halves are brought into an engaged disposition and the saddle 50 is closed over the housing 12, they will be engaged by the inwardly-facing shoulders 58 formed in the saddle 50. Consequently, separation of the housing halves 14,14' will be precluded.

FIGS. 2, 3, and 4 illustrate a latch 62 defined at each of two axially-extending edges of the saddle 50. These latch mechanisms 62 comprise inwardly-turned lips. The lips are, in turn, engagable with an axially-extending surface 64 formed in the housing 12. While it is understood that the axially-extending surface 64 formed in the housing might extend along only one of the housing halves, it is envisioned that the surface 64 would be continuous along one half to the other. Similarly, it is envisioned that such a surface 64 be provided on either side of the housing 12 for cooperation with a latch 62 defined at either axially-extending edge of the saddle 50. Such a construction will effect maintenance of the saddle 50 in its position capturing the housing 12.

It will be understood that the saddle 50 would be provided with some measure of flexibility. This is so in order to enable detachment of a latching mechanism 62 from the corresponding axially-extending surface 64 formed along the housing 12 so that the saddle 50 can be removed from the housing 12.

FIG. 2 illustrates the sharpening device of the present invention in an assembled configuration. It will be seen that a recess 46 is defined by registered holes within the saddle 50, housing 12, and abrasive element holder 18. This recess 46 is shown as being circumferentially spaced from the slot 28 through an arc of some measure. The recess 46 affords access to the abrasive element so that it can be rotated within its cavity 32 in order to present a different surface to the slot 28 and the skate blade being passed therethrough. The degree of circumferential spacing of the recess 46 from the slot 28 is of a measure to make the device 10 ergometrically functional, and 90° has been found to be an acceptable circumferential spacing.

In order to facilitate manufacture, the housing 12 can be made from acetal. Similarly for ease of manufacture, the abrasive element holders 18 can be manufactured from high density polyethylene. These materials enable the sharpening device to be molded rather than having to be machined.

Numerous characteristics and advantages of the invention covered by this document have been set forth in the foregoing description. It will be understood, however, that this disclosure is, in many respects, only illustrative. Changes may be made in details, particularly in matters of shape, size, arrangement of parts without exceeding the scope of the invention. The invention's scope is, of course, defined in the language in which the appended claims are expressed.

What is claimed is:

1. Apparatus for sharpening a blade of an ice skate, comprising:

a plurality of abrasive element holders, each having an external profile substantially the same as that of the other holders, each holder having a cavity formed therein to receive an abrasive element with an arcuate surface having a radius of curvature different from that of abrasive elements receivable in other holders, and to expose the arcuate surface of the abrasive element on a side of the holder;

a housing having a chamber formed therewithin, said chamber shaped and sized to receive, alternately, each of said plurality of abrasive element holders therein, said housing having an elongated slot communicating with said chamber formed therein and sized to permit a blade of an ice skate to pass therethrough; and means for orienting an abrasive element holder received in said chamber with the exposed arcuate surface of an abrasive element received in the cavity in the holder addressing said slot.

2. Apparatus in accordance with claim 1 wherein each of said plurality of abrasive element holders is generally cylindrical, and wherein said chamber formed within said housing is cylindrical and sized to receive each of said plurality of abrasive element holders.

3. Apparatus in accordance with claim 2 wherein a cavity formed in an abrasive element holder is cylindrical and eccentric with respect to a longitudinal axis of the abrasive element holder in which it is formed, and wherein an abrasive element is sized and shaped to be received within the cavity formed in a corresponding holder.

4. Apparatus in accordance with claim 3 wherein said housing is bifurcated along a plane generally perpendicular to a longitudinal axis of said chamber formed therewithin.

5. Apparatus in accordance with claim 4 further comprising means for registering a first housing portion in alignment with a second housing portion.

6. Apparatus in accordance with claim 5 wherein said registration means comprises a plurality of alignment pins, each extending from one of said housing portions and receivable within an alignment aperture formed in the other of said housing portions.

7. Apparatus in accordance with claim 6 further comprising means for maintaining said housing portions in a mated configuration.

8. Apparatus in accordance with claim 7 wherein said maintaining means comprises a saddle receivable over said housing straddling a seam at which said housing portions engage, said saddle having, at each of opposite axial end portions thereof, an inwardly facing shoulder engagable, when said saddle is received over said housing, with an outwardly facing shoulder defined in each of said housing portions.

9. Apparatus in accordance with claim 8 further comprising means for securing said saddle to said housing portions.

10. Apparatus in accordance with claim 9 wherein said securing means comprises a latch, defined in at least one axially-extending edge of said saddle, engagable with an axially-extending surface formed in at least one of said housing portions.

11. Apparatus in accordance with claim 3 wherein said orienting means comprises a key extending from each of said plurality of abrasive element holders receivable, when a particular holder is received in said chamber, in a corresponding keyway formed in a surface of said housing defining said chamber.

12. Apparatus in accordance with claim 11 wherein said keyway is circumferentially spaced approximately 180° from said slot.

13. Apparatus in accordance with claim 3 wherein an abrasive element can be rotated when it is received within its corresponding holder and the holder is received within the chamber formed within the housing.

14. Apparatus in accordance with claim 13 wherein a recess, spaced circumferentially from said slot, is formed through said housing and an abrasive element holder received within said housing to expose said abrasive element.

15. Apparatus in accordance with claim 14 wherein said recess is circumferentially spaced from said slot at an angle between 45° and 135°.

16. Apparatus in accordance with claim 15 wherein said recess is circumferentially spaced from said slot at substantially 90°.

17. Apparatus in accordance with claim 1 wherein said abrasive element holders are formed of high density polyethylene.

18. Apparatus in accordance with claim 1 wherein said housing is formed of acetal.

* * * * *